United States Patent [19]

Guion

[11] Patent Number: 4,602,446

[45] Date of Patent: Jul. 29, 1986

[54] PORTABLE IRONING BOARD

[76] Inventor: Josephine Guion, Rte. 1, Box 48, Hollywood, Md. 20636

[21] Appl. No.: 760,159

[22] Filed: Jul. 29, 1985

[51] Int. Cl.[4] ..... D06F 81/02

[52] U.S. Cl. ..... 38/139; 38/140; 108/34; 108/91; 108/102; 108/112

[58] Field of Search ..... 108/91, 102, 90, 34, 108/112; 211/149, 151; 38/103, 112, 135, 136, 137, 138, 139, 140

[56] References Cited

U.S. PATENT DOCUMENTS

| | | | |
|---|---|---|---|
| 88,281 | 3/1869 | Montigny . | |
| 357,614 | 2/1887 | Lutz . | |
| 539,535 | 5/1895 | McKissack | 38/138 |
| 912,319 | 2/1909 | Nelson | 38/138 |
| 1,078,882 | 11/1913 | Scott . | |
| 1,214,334 | 1/1917 | Longstreet . | |
| 1,570,955 | 1/1926 | Evans . | |
| 2,276,981 | 3/1942 | John . | |
| 2,404,194 | 7/1946 | Sass | 38/138 |
| 2,499,078 | 2/1950 | Shaw . | |
| 2,622,353 | 12/1952 | Mendelson | 38/137 |
| 2,950,552 | 8/1960 | Stephany . | |
| 2,969,603 | 1/1961 | O'Buckley | 108/34 |
| 3,609,892 | 10/1971 | Caire | 38/138 |
| 4,168,671 | 9/1979 | Roberts et al. . | |

*Primary Examiner*—Henry S. Jaudon
*Assistant Examiner*—Andrew M. Falik
*Attorney, Agent, or Firm*—Schwartz, Jeffery, Schwaab, Mack, Blumenthal & Evans

[57] ABSTRACT

An ironing board comprises a plurality of sections which are connected by a link system. The sections are graded in size such that adjacent sections can be nested within one another. The link system comprises individual links having sufficient length to permit the sections to go from a nested condition to an aligned condition.

8 Claims, 6 Drawing Figures

PORTABLE IRONING BOARD

BACKGROUND OF THE INVENTION

Field of the Invention

This invention relates to portable, collapsible ironing boards, and particularly to such ironing boards wherein all of the elements are interconnected and can be pivoted from a storage position to an operative position.

Ironing boards have been known and used for a multitude of years. However, most of these devices are large and bulky, require a fairly substantial storage area and are not useful to someone who travels. For example, college students, travelling businessmen and the military have a need for an ironing board which is light, compact, easily portable, yet sturdy and reliable in use. There is no known ironing board which satisfactorily meets all of these requirements.

SUMMARY OF THE INVENTION

One object of the present invention is to provide an improved ironing board which may be nested into a compact configuration when not in use.

Another object of the present invention is to provide an ironing board which is completely portable and adapted for storage in small places.

A further object of the present invention is to provide an ironing board which can be packed into a suitcase due to its reduced bulk and weight, or hand carried like a briefcase.

Yet another object of the present invention is to provide an ironing board which may be used on tabletops, countertops, or any surface suitable for providing a firm base.

A still further object of the present invention is provide a cover material for the ironing board which is suitable for use as an enclosure for the collapsed and stored ironing board and also doubles as a covering material to provide an ironing surface when the board is in use.

In accordance with the above and other objects, the present invention is a collapsible, portable ironing board. The board is comprised of a plurality of individual sections and a linkage system which interconnects the sections. The sections are reduced in size from one end of the ironing board to the other and the linkage system permits the sections to be nested for storage. In use, the sections are extended out into a common plane. Each section has beveled edges for connection to the adjacent sections to provide stability and strength. The end sections of the board contain legs which may be folded onto the underside of the board when nested. A quilted cover is provided with an attached handle. The cover folds to enclose the nested board within itself and then is secured with Velcro strips or snap buttons to facilitate storage and portability.

BRIEF DESCRIPTION OF THE DRAWINGS

The above and other objects of the present invention will become more readily apparent as the invention is more fully understood from the detailed description below, reference being had to the accompanying drawings in which like reference numerals represent like parts throughout, and in which.

DETAILED DESCRIPTION OF THE PREFERRED EMBODIMENT

Figure 1:
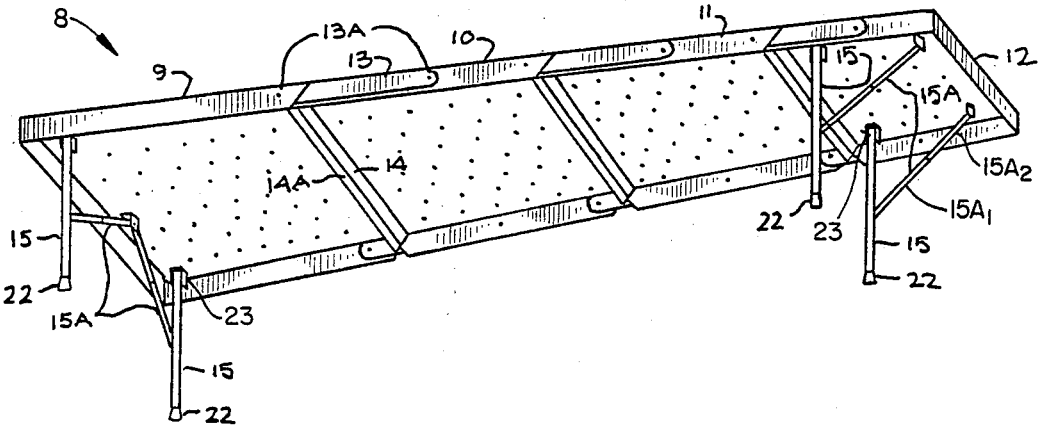
FIG. 1 is a perspective view of the ironing board showing the underside of the board.
Figure 2:
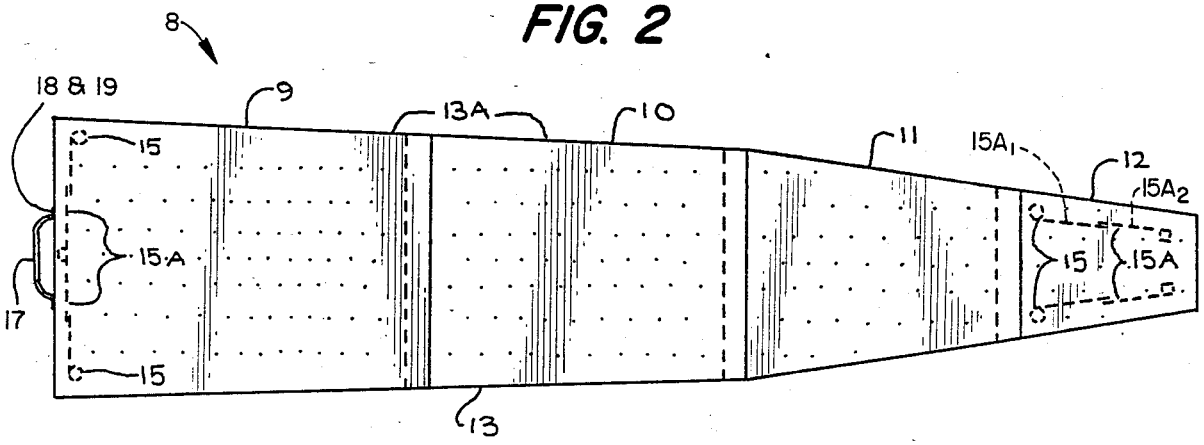
FIG. 2 is a top plan view of the ironing board.
Figure 3:
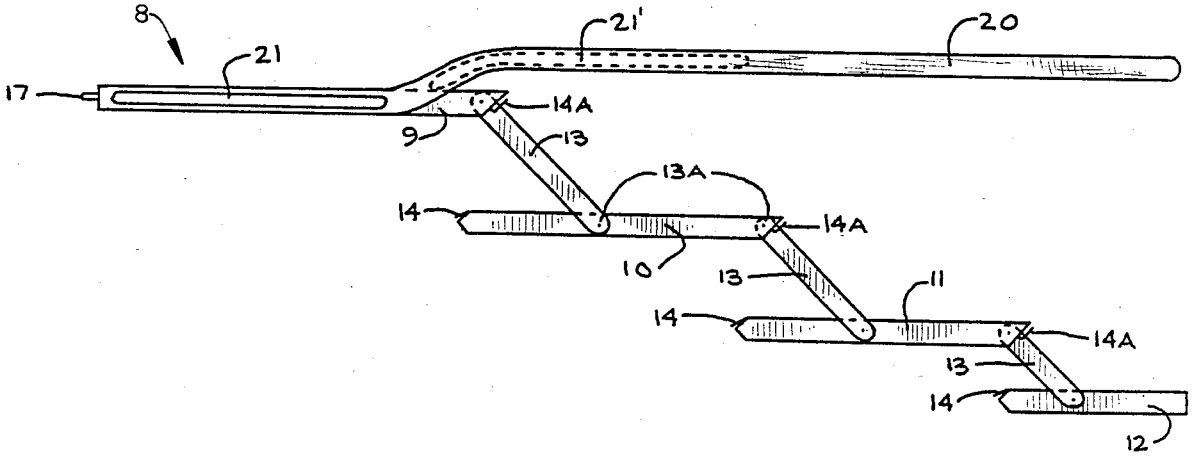
FIG. 3 is a side elevational view of the ironing board sections and linkage system and the quilted cover.
Figure 5:
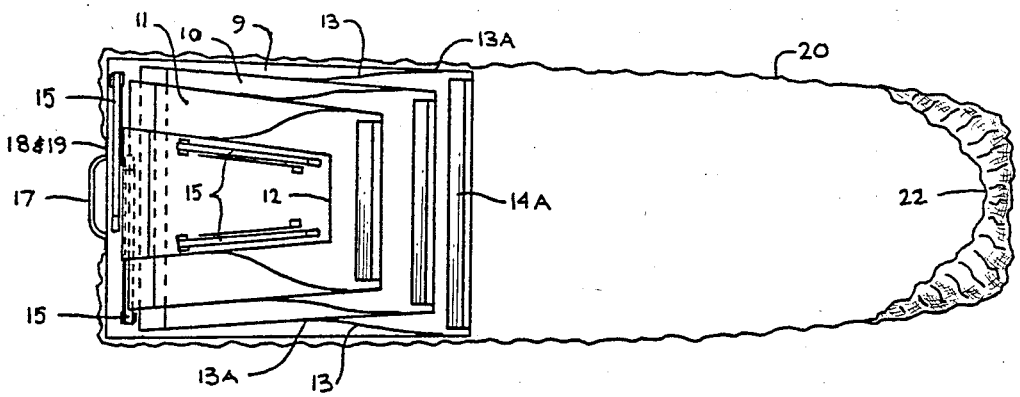
FIG. 5 is a plan view showing the nested sections ready to be covered by the ironing board cover for storage.
Figure 6:
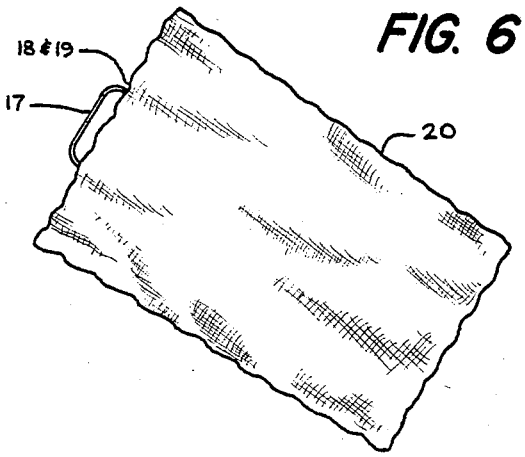
FIG. 6 shows the nested ironing board enclosed within the quilted cover.

With reference to FIGS. 1 through 3, it will be seen that the ironing board 8 comprises four individual sections 9, 10, 11 and 12. Each section is preferably made of either sheet metal, aluminum, tin or other suitable material which is both light in weight to allow for easy handling and strong enough to withstand normal pressure and heat produced during ironing. As seen most clearly in FIG. 2, the sections 9 through 12 are arranged such that their widths and lengths decrease from section 9 through section 12. In this manner, each section can fit wholly beneath the section to its immediate left as shown in the drawings. Each section includes a hollow portion defined by an upper ironing surface and four side flanges. The flanges provide rigidity and in some cases, aid in connection to the next adjacent section, as will be discussed. The relative sizes of the sections permits them to be nested within one another for storage. FIG. 5 clearly shows that the sections nest conveniently and easily within one another to provide a package which is compact in length and width as well as depth.

The linkage system is most clearly shown in FIGS. 1 and 3. This system comprises a plurality of connecting links 13 which are pivoted at points 13A to adjacent sections. For example, links 13 between sections 9 and 10 are pivoted close to the edge of section 9 which is adjacent to section 10 and also pivoted toward the longitudinal center of section 10. The exact position of the pivots 13A on section 10 is determined by the length of travel required in order to nest section 10 in section 9. That is, in order to nest the sections, section 10 is moved parallel to section 9 from a position aligned with section 9 to a position nested within section 9. Also as shown in FIG. 3, links 13 are disposed on the inside of the side flanges of section 9 and on the outside of the side flanges of section 10 such that the links are contained between sections 9 and 10 when these sections are nested. The nesting of the sections enables the collapsed board to have a thickness which approximates the thickness of one section.

In order to connect the sections 9 through 12 together, the rear edge 14 of each section is beveled at a 45° angle and the forward edge of each section is beveled at 45° and contains a 45° angled lip 14A to form a slot. Lip 15A slides beneath edge 14 to form a connection between sections 9 and 10. Sections 10 and 11, and sections 11 and 12 are connected in a similar manner.

Figure 4:
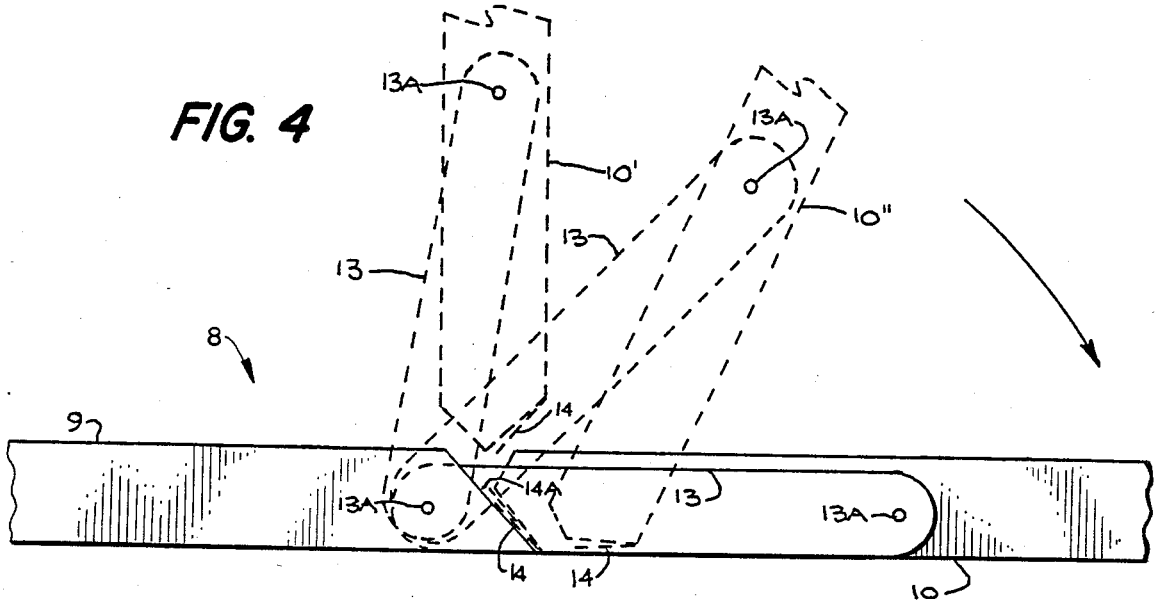
FIG. 4 is a fragmentary view showing one beveled connection between adjacent sections of the ironing board.

FIG. 4 actually shows the manner in which sections 9 and 10 would be attached together. In FIG. 4 the board 8 is shown upside down as it would be resting on a support surface when being readied for use. Section 10 is shown in two positions in phantom at 10' and 10'' as it is pivoted such that edge 14 slides under lip 14A. Once the section 10 is properly connected to section 9, the ironing board can be turned over for use, assuming that the other sections are properly connected also.

It will be noted that links 13 add stability and rigidity to the ironing board when it is fully deployed. These links must be sufficient in length to enable the connection to be made between edge 14 and lip 14A. For example, in the case of sections 9 and 10, the links 13 must be at least as long as the distance from pivot point 13A on section 10 to edge 14 of section 10 plus the distance from lip 14A on section 9 to the pivot point on section 9. In addition, the pivot points 13A must be placed such that lip 14A of section 10 is positioned behind lip 14A of section 9 when the sections are nested.

On the underside of sections 9 and 12, legs 15 are mounted. These legs are shown most clearly in FIGS. 1 and 2. The legs can be tubular steel with rubber tips 22 attached. The legs are pivoted at pivot points 23 by any convenient hinge connection. A brace 15A is connected to each leg to hold it erect. Each brace 15A comprises two sections $15A_1$ and $15A_2$ which are pivoted together at adjacent ends. The opposite end of section $15A_1$ is pivoted to leg 15 and the opposite end of section $15A_2$ is pivoted to the base of one of the sections 9 or 12. A detent is provided at the connection between sections $15A_1$ and $15A_2$ to hold these sections in a straight line. Accordingly, legs 15 are held erect by extending sections 15A. When the ironing board is collapsed, sections 15 are pushed toward the bottom of the ironing table and the legs 15 are pivoted downward to rest directly against the bottom of the table. As shown in FIGS. 1 and 2, legs 15 attached to section 9 will pivot toward one another whereas legs 15 attached to section 12 will pivot toward the front of section 12. Of course, the legs can be attached at any other convenient location. It should also be noted that the length of legs 15 should be sufficiently short to be received fully within the section of the ironing board to which they are connected. That is, the maximum length of legs 15 attached to section 9 would be the width of section 9. Alternatively, telescoping legs could be used so that the board could stand at a greater height. Nevertheless, the collapsed length of such telescoping legs would have to be sufficient to be received within the sections to which they are connected.

A quilted cover 20 has a handle 17 which is secured to the ironing table by means of bolts 18 which extend through holes in the handle and extend into holes in the rear edge of section 9. Nuts 19 can be used to secure screws 18 in place. The bolts and nuts are shown most clearly in FIGS. 2 and 3.

Mating Velcro strips 21 and 21' are spaced along the edge of cover 20 an are attached outside and inside, respectively, of the cover, as shown in FIG. 3. Only one set of strips 21, 21' is shown in FIG. 3 but it will be understood that a similar set of strips is attached along the opposite edge of cover 20. Clearly, when the ironing board 8 is fully deployed, the cover 20 is pulled along the upper surface of the board and connected in a conventional manner using an elastic strip 22, shown in FIG. 5, which is pulled over the extreme end of section 12. When the ironing board is collapsed, the cover 20 is folded such that the end of the cover which extends past strips 21' is folded underneath the cover. Then the section containing strips 21' is folded over the bottom of the nested ironing board and the edges containing strips 21' are pulled over the edges containing strips 21 such that the strips connect together to form a neat, compact package which holds the nested ironing board in place as well as provides an attractive covering for the board.

The ironing board 8 can include other features. For example, each of the sections 9 through 12 can be perforated as shown in FIGS. 1 and 2 to further reduce weight. Other modifications to the ironing board would be readily apparent to one of ordinary skill in the art.

The foregoing description is provided for illustrating the present invention and is not considered to be limitative thereof. Clearly, numerous additions, substitutions and other modifications could be made without departing from the scope of the present invention as set forth in the appended claims.

What I claim is:

1. A collapsible, nesting ironing board comprising:

a plurality of hollow ironing board sections, said sections being graded in size from a larger section to a smaller section to enable said sections to nest within one another such that the thickness of the collapsed board approximates the thickness of one section;

a linkage system interconnecting said sections, said linkage system comprising links which extend between adjacent ones of said sections, said links being of sufficient length to enable said adjacent sections to be moved from a nested position to an aligned position relative to one another; and means for interconnecting said adjacent sections when in said aligned position, and a cover connected to one end of one of said sections, said cover having a length sufficient to cover said ironing board when said sections are in said aligned position, said including means for retaining said cover in a position wrapped around said ironing board when said ironing board is in said nested position such that said cover acts as a carrying case for said ironing board.

2. An ironing board as set forth in claim 1 wherein said means comprises a lip formed on one of said adjacent sections and a free edge formed on the other of said adjacent sections for receipt in said lip.

3. An ironing board as set forth in claim 2 wherein said lip and said free edge are at a 45° angle relative to said adjacent sections.

4. An ironing board as set forth in claim 1 including a handle attached to said cover.

5. An ironing board as set forth in claim 1 wherein each of said sections has depending flanges for providing strength.

6. An ironing board as set forth in claim 1 including legs attached to an underside of certain of said sections, said legs being pivotally connected and having a length such that said legs can be received wholly within the sections to which they are attached.

7. A portable, collapsible ironing board which can be extended for use, comprising:

a least two sections, each of said sections including a substantially planar portion having an upper ironing surface and a plurality of depending flanges attached to the sides of said sections, each of said sections having a length which is less than the length of said ironing board when extended;

a linkage system connecting said sections such that adjacent sections can be pivoted relative to one another, said sections being graded in size such that each section can be wholly received within the depending flanges of an adjacent section, said linkage system comprising individual links extending between said adjacent sections, said links having a pivotal connection at one end on an inside surface of a depending flange of a larger section and having a pivotal connection at an opposite end on an outside surface of a depending flange of an adjacent section, said links being of sufficient length to permit adjacent sections to be moved from a position aligned with one another to a position nested within one another such that the collapsed ironing board has a thickness which approximates the thickness of one section; and connecting means attached to abutting edges of said adjacent sections for connecting said adjacent sections together.

8. An ironing board as set forth in claim 7 wherein said connecting means comprises an angled edge on one of said adjacent sections and an angled slot on the other adjacent section to receive said angled edge.

* * * * *